United States Patent [19]

Salazar

[11] Patent Number: 4,936,619

[45] Date of Patent: Jun. 26, 1990

[54] HAND GRIP FOR A BAG

[76] Inventor: John Salazar, 3831 Heather St., Vancouver, B.C., Canada, V5Z 3L4

[21] Appl. No.: 350,794

[22] Filed: May 12, 1989

[51] Int. Cl.[5] ..... A45C 13/26; A45F 5/10; B65D 33/06

[52] U.S. Cl. ..... 294/171; 383/13

[58] Field of Search ..... 294/25, 27.1, 33, 137, 294/141–143, 148, 166, 167, 170, 171; 16/114 R, 114 B, DIG. 12; 220/94 R, 96; 383/6, 12, 13, 23, 25, 26, 29; 229/117.19, 117.23–117.25

[56] References Cited

U.S. PATENT DOCUMENTS

| | | | |
|---|---|---|---|
| D. 268,815 | 5/1983 | Schwalbach | 294/171 X |
| 1,239,468 | 9/1917 | Desplats | 294/137 |
| 1,468,848 | 9/1923 | Wear | 294/171 X |
| 1,576,546 | 3/1926 | Ransom | 294/171 |
| 2,348,964 | 5/1944 | Dodson | 383/6 X |
| 2,981,990 | 5/1961 | Balderree | 294/137 X |
| 3,512,701 | 5/1970 | Kamins et al. | 383/13 |
| 3,692,218 | 9/1972 | Friedman | 294/167 X |
| 3,912,140 | 10/1975 | Franges | 294/17 X |
| 4,590,640 | 5/1986 | Enersen | 294/171 X |
| 4,621,855 | 11/1986 | Kroll | 294/171 |
| 4,772,133 | 9/1988 | Volk | 294/137 X |
| 4,796,940 | 1/1989 | Rimland | 294/171 |

FOREIGN PATENT DOCUMENTS

| | | | |
|---|---|---|---|
| 2725481 | 12/1978 | Fed. Rep. of Germany | 294/171 |
| 2840676 | 4/1980 | Fed. Rep. of Germany | 294/171 |
| 1371920 | 8/1964 | France | 294/171 |
| 2113081 | 8/1983 | United Kingdom | 294/171 |
| 2147200 | 5/1985 | United Kingdom | 294/171 |
| 2153213 | 8/1985 | United Kingdom | 294/171 |

*Primary Examiner*—Johnny D. Cherry
*Attorney, Agent, or Firm*—Shlesinger & Myers

[57] ABSTRACT

A hand grip for carrying one or more plastic bags or the like which includes an elongate tubular element having a hollow interior and a pair of spaced apart panels. The panels are affixed to the tubular element and diverge outwardly therefrom defining a channel therebetween which communicates with the interior of the tubular element through an opening dimensioned to provide some resistance to passage therethrough of a bag handle.

10 Claims, 3 Drawing Sheets

HAND GRIP FOR A BAG

FIELD OF THE INVENTION

The present invention relates to hand grips or bags having handle openings or handles, particularly for plastic shopping or grocery bags.

BACKGROUND OF THE INVENTION

The recent increase in popularity of plastic shopping bags for use by the majority of supermarkets and other retail outlets has carried with it an associated problem of discomfort associated with the effect of the handle openings on the hand of a user when such bags are loaded with heavy goods. The problem is further aggravated when shoppers carry more than one bag in a single hand.

Various hand grips have been devised to alleviate the foregoing problem. U.S. Pat. No. 1,576,546 issued Mar. 16, 1926 to Ransom discloses a package carrier of a length corresponding to the width of a hand and U-shaped in cross-section. Ends of the carrier are bent inwardly to form lugs which are adapted to retain a cord or string associated with a package or bag.

U.S. Pat. No. 1,468,848 issued Sept. 25, 1923 to Wear discloses a market bag holder having a base adapted to conform to the fingers of a hand, a pair of elongated channels formed along an upper surface of the base to receive the strings of a bag and an upstanding soft pliable pad to fit against the palm of a hand. The arcuate shape developed by the Ransom carrier tends to also bias the palm of a hand toward an arcuate shape which, in itself, creates discomfort and aggravation to a user. Since the Wear holder exhibits no means for capturing a cord, the device would have to be repositioned with respect to the strings of a bag if a user released his grip. In addition, the device would exhibit some tendency to slide off of the bag holder in the event the bag holder were tilted toward one side.

U.S. Pat. No. 3,912,140 issued Oct. 14, 1975 to Franges discloses a handle for packages which closes on itself and retains a cord or string of a package or bag locked into a bottom surface thereof by retainer segments. The Franges device is relatively complicated and hence expensive to fabricate as well as being somewhat awkward to use in that because of a tight frictional engagement of grooves along the top of each of the sides of the carrier the sides of the device have to be pried apart in order to open it.

U.S. Design Pat. No. 268,815 issued May 3, 1983 to Schwalbach discloses a carrying handle having two diverging panels joined at the bottom in an arcuate channel. One of the panels of the carrying handle has a handle opening proximate the top thereof and a reinforced handle portion with finger grips including snap fastening buttons to allow attachment of the other panel. The need to use snap fasteners in order to lock a bag handle is a relatively expensive and somewhat awkward system.

U.S. Pat. No. 4,590,640 issued May 27, 1986 to Enersen discloses a handle for a plastic bag consisting of an arcuate elongated channel in a rounded cylindrical block having two spaced apart upwardly projecting sides forming the channel opening. The Enersen device which is relatively bulky has a solid body and no means for locking onto the handle of the bag so as to allow the user or shopper to release the device and then recapture it without having to reposition the device under a handle opening.

Finally, U.S. Pat. No. 4,796,940 issued Jan. 10, 1989 to Rimland discloses a handle grip consisting of a flexible plastic rectangular planar configuration which is bendable to a U-shaped configuration with the bent portions capable of being locked together with a fastening element. The Rimland device in having rectangular sides would be relatively difficult to fit through and position within the handle opening of a bag and, moreover, requires a separate element die-cut in the side of one of the panels to be threaded through an opening on an opposite one of the panels. Clearly the fastening element would have a tendency after a few operations to tear away from the remainder of the panel In any event, the fastening method disclosed is somewhat awkward.

Accordingly, it is the object of the invention to provide an improved handle grip for carrying bags having handle openings or handles. It is a further object of the invention to provide a hand grip of a relatively simple design which is inexpensive and without any moving parts. It is yet a further object of the invention to provide a hand grip which is capable of interlocking with an identical hand grip for more convenient storage.

SUMMARY OF THE INVENTION

According to the invention there is provided a hand grip for carrying one or more plastic bags or the like, and includes an elongate tubular element and a pair of spaced apart panels integral with the tubular element and diverging outwardly therefrom. The panels define a channel therebetween which communicates with the interior of the tubular element through an opening dimensioned to provide some resistance to passage therethrough of a bag handle. The width of the channel at distal ends of the panels is spaced apart sufficiently so as to facilitate enclosing one or more bag handles and yet is sufficiently narrow at the entrance to the interior of the tubular element to prevent the hand grip from falling off of the handle of a bag to which it is attached when the user releases pressure from the handle grip. The interior of the tubular element proximate the channel is wider than the channel.

Advantageously the panels extend out from the tubular element a distance of at least the width of the tubular element. One of the panels may have side edges which converge, outwardly from the tubular element with one panel extending out from the tubular element a distance substantially greater than the other. A relatively short distal side edge on the one panel facilitates its insertion through a handle opening and around the handle of a bag.

Preferably the distal portions of the panels are shaped to interlock with those of another panel so a distal portion of a first panel of the pair of panels conforms to and fits against the outer surface of the tubular member of another grip. A second panel of the pair of panels fits between a pair of panels of the other hand grip and extends into a hollow cylindrical interior thereof. The provision of such interlocking allows a user to interlock together two hand grips so as to occupy little more than the space ordinarily occupied by only one handle grip.

It will be appreciated that the above-mentioned handle grip is of a relatively simple one piece design with no moving parts, is easy to position through the handle openings of a bag and is dimensioned to lock onto the bag handles in order to prevent accidental removal of a bag handle from the hand grip.

BRIEF DESCRIPTION OF THE DRAWINGS

The novel features believed characteristic of the invention are set forth in the appended claims. The invention itself, however, as well as other features and advantages thereof, would be best understood by reference to the detailed description which follows, read in conjunction with the accompanying drawings, wherein:

DETAILED DESCRIPTION WITH REFERENCE TO THE DRAWINGS

Figure 1:
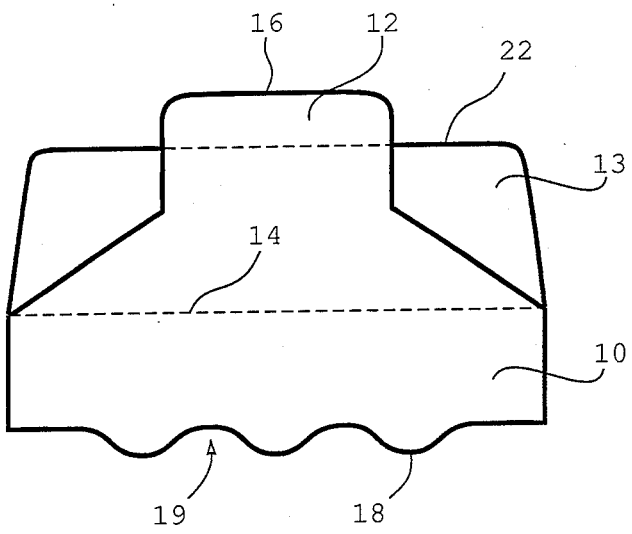
FIG. 1 is a side elevation view of the hand grip.
Figure 2:
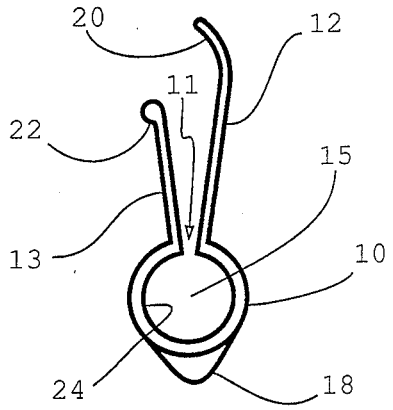
FIG. 2 is an end elevation view of the hand grip of FIG. 1.

FIGS. 1 and 2 illustrate the handle grip consisting of a hollow tubular element 10 and a pair of outwardlY diverging projecting panels 12 and 13 joined to the tubular element 10 along edges 14. Panels 12 and 13 extend along the length of the tubular element 10. Panel 12 has a curved distal portion 20 terminating in a distal edge 16, remote from its point of connection to tubular element 10 and converging side edges. Panel 13 is shorter than panel 12 and has a thickened distal portion 22 with only slightly diverging side edges. The space between the panels 12 and 13 defines a channel which gradually reduces in width and communicates through an opening 11 with the interior 15 of the hollow tubular element 10 bounded by interior surface 24. Along the base of the tubular element 10 are a plurality of spaced apart projections 18, the area between which forms finger grooves 19.

Figure 3:
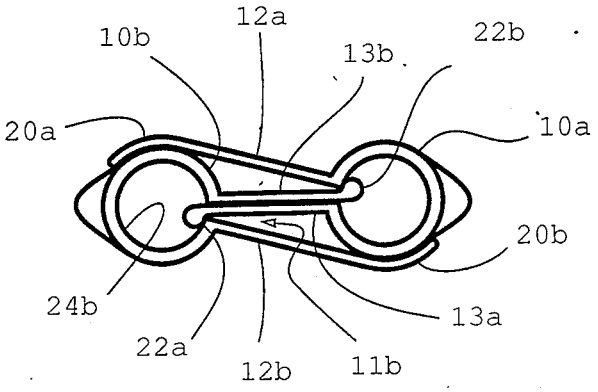
FIG. 3 is an end elevation view of two hand grips in interlocked position.

Referring to FIG. 3 it is seen that the dimensions of the panels 12 and 13, that of the corresponding curved portion 20 and that of thickened portion 22 are such that two hand grips can be stored in an interlocked relationship. In the interlocking position curved portion **20*a* of panel 12*a* conforms to the shape of the exterior surface of tubular element 10*b*. Similarly, curved portion 20*b* of panel 12*b* conforms to the shape of the exterior surface of tubular element 10*a*. Panel 13*a* is dimensioned to fit through the channel opening 11*b* with the thickened portion 22*a* passing below opening 11*b* contacting a portion of interior surface 24*b* of tubular element 10*b* by sliding the two hand grips together end to end. Panel 13*a* is juxtaposed and contiguous with panel 13*b*. The panel members are made of a resilient plastic material which allows bending of the distal portions 22*a* and 22*b*** to facilitate removal from the interlocked position.

Figure 4:
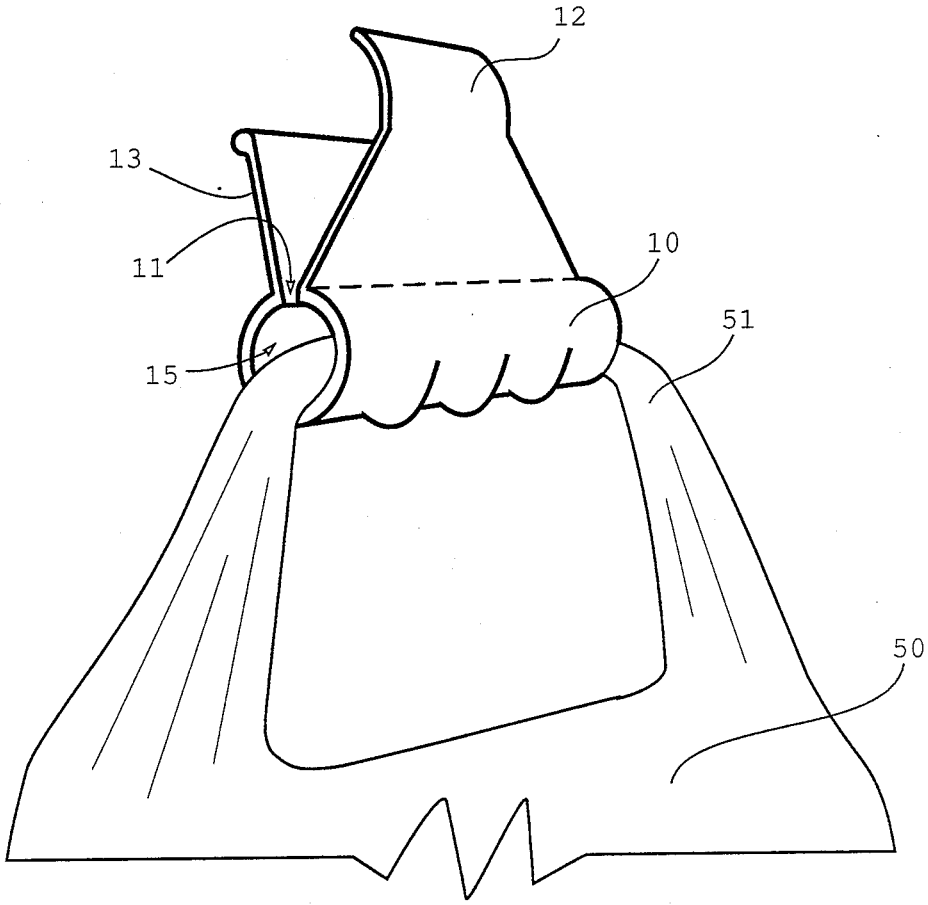
FIG. 4 is a perspective view of the hand grip with a plastic bag gripped thereby.

In operation a user positions handle loops of one or more plastic bags 50 over panel 12 and between panels 12 and 13 and pushes up on tubular element 10 until loops 51 pass through opening 11 and enter the interior 15 of element 10 as shown in FIG. 4. The longer length of panel 12 as compared to panels 13 and the curvature of portion **20*a* assists in locating plastic bag handle loops between the panels. The converging side edges of panel 12 provides a space at each end of the hand grip between the panels to locate the bag loops as well. The fingers are then placed around the tubular element 10. If the bags so retained are placed on the ground for any reason, the restricted opening 11** prevents release of the hand grip from the bag loop.

Figure 5:
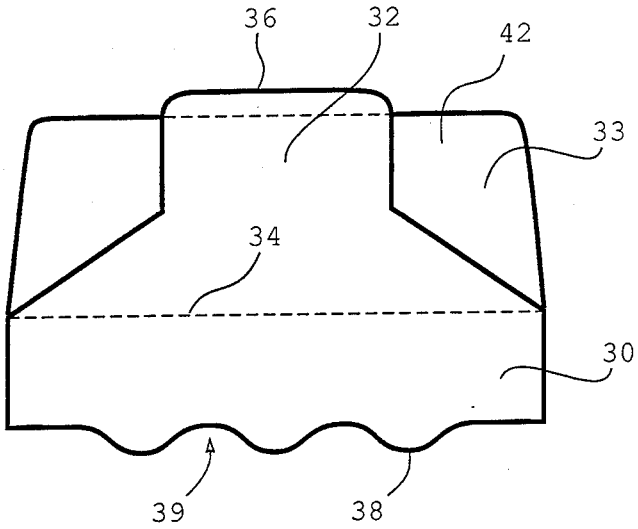
FIG. 5 is a side elevation view of a variant of the hand grip.
Figure 6:
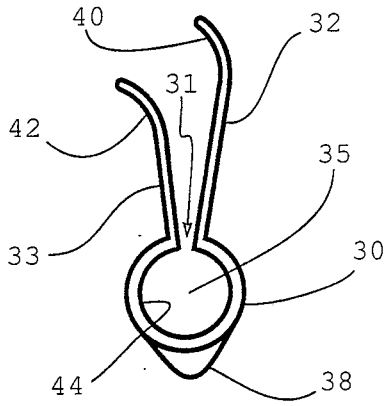
FIG. 6 is an end elevation view of the hand grip of FIG. 4.
Figure 7:
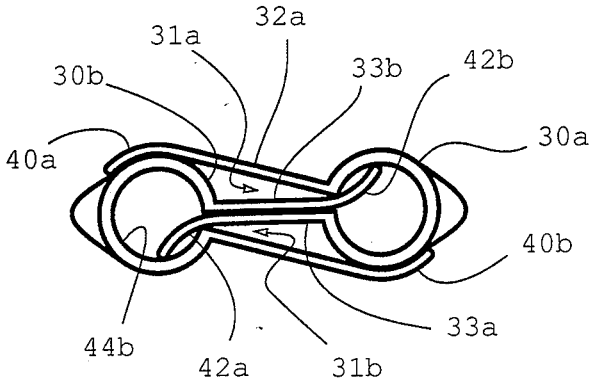
FIG. 7 is an end elevation view of two hand grips in interlocked position.

An alternative design is shown in FIGS. 5, 6 and 7. In this design variant a tubular element 30 with handle projections 38 defining finger grooves 39 has two diverging panels 32 and 33 integral therewith along line 34. Side edges of each panel 32 and 33 converge from a bottom side edge 34 at the junction of each panel with tubular element 30 up to a top side edge 36. Top side edge 36 is substantially shorter than bottom side edge 34. A distal portion 40 and 42 of each panel 32 and 33, respectively, is curved and the interior of the panels defines a channel of diverging width with increasing distance away from tubular element 30.

The channel opening 31 at the juncture of panels 32 and 33 with tubular element 30 is sufficiently narrow so as to provide some resistance to the passage therethrough of a plastic bag handle (not shown) on entry to the interior 35 of tubular element 30.

Interlocking of two hand grips as seen in FIG. 7 is similar to that shown in FIG. 3 with curved portions **40*a* and 40*b* of panels 32*a* and 32*b*, respectively, contacting a portion of the outer surface of tubular elements 30*b* and 30*a*, respectively, except that the curved portion 42*a* of panel 33*a* passes through channel opening 31*b* and abuts an interior surface 44*b* of tubular element 30*b*. Similarly, curved portion 42*b* of panel 33*b* passes through channel opening 31*a***.

Accordingly, while this invention has been described with reference to illustrative embodiments, the description is not intended to be construed in a limiting sense. Various modifications of the illustrative embodiment, as well as other embodiments of the invention, will be apparent to persons skilled in the art of upon reference to this description. It is therefore contemplated that the appended claims will cover any such modifications or embodiments as fall within the true scope of the invention.

I claim:

1. A hand grip for carrying one or more plastic bags or the like, comprising:

(a) an elongate tubular element having a hollow interior; and (b) a pair of spaced apart panels affixed to said tubular element and diverging outwardly therefrom, said panels defining a channel therebetween which communicates with the interior of said tubular element through an opening dimensioned to provide some resistance to passage therethrough of a bag handle and the interior of said tubular element proximate said channel being larger than said channel.

2. A hand grip according to claim 1, wherein at least one of said panels has side edges which converge outwardly from said tubular element, has an outer portion curved toward the other panel and is substantially longer than said other panel.

3. A hand grip according to claim 1, wherein each of said panels extends outwardly from said tubular element a distance at least equal to the width of said tubular element.

4. A hand grip according to claim 1, wherein said tubular element is cylindrical and said panels extend outwardly and are dimensioned to engage said tubular element of another hand grip so as to interlock with said another hand grip.

5. A hand grip according to claim 4, wherein a distal portion of a first of said panels is curved such that the distal portion thereof conforms to and fits against an outer surface of a tubular element of another hand grip and a second of said panels fits between panels of another hand grip juxtaposed to a corresponding second panel thereof and extends into a hollow cylindrical interior of a tubular element of said another hand grip.

6. A hand grip for carrying one or more plastic bags or the like, comprising:

(a) an elongate tubular element having a hollow interior; and (b) a pair of spaced apart panels integral with said tubular element and diverging outwardly therefrom and defining a channel communicating with the interior of said tubular element through an opening of a width so as to provide slight resistance to passage therethrough of a bag handle, at least one of said panels having opposed side edges which converge outwardly from said tubular element and extend outwardly a distance substantially greater than another of said pair of panels.

7. A hand grip according to claim 6, wherein said panels extend a width at least equal to the width of said tubular element and said one panel has a curved outer portion which curves towards a second of said panels.

8. A hand grip according to claim 6, wherein said panels extend outwardly to engage said tubular element of another hand grip so as to interlock with said another hand grip.

9. A hand grip according to claim 6, wherein said tubular element is cylindrical.

10. A hand grip according to claim 9, wherein a first one of said panels has a curved outer portion to conform to an outer surface of a tubular element of another hand grip and a second one of said panels has an outer portion shaped to fit through the opening to a tubular element of another hand grip and resist withdrawal therefrom when the outer portion of said first panel is in place against the outer surface of said tubular element of another hand grip.

* * * * *